US012768533B2

(12) United States Patent
Yang

(10) Patent No.: US 12,768,533 B2
(45) Date of Patent: Oct. 20, 2026

(54) FLAME TORCH

(71) Applicant: Pro-Iroda Industries, Inc., Taichung City (TW)

(72) Inventor: Cheng Nan Yang, Taichung City (TW)

(73) Assignee: Pro-Iroda Industries, Inc., Taichung City (TW)

( * ) Notice: Subject to any disclaimer, the term of this patent is extended or adjusted under 35 U.S.C. 154(b) by 573 days.

(21) Appl. No.: 18/347,684

(22) Filed: Jul. 6, 2023

(65) Prior Publication Data

US 2024/0369219 A1 Nov. 7, 2024

(30) Foreign Application Priority Data

May 3, 2023 (TW) ..... 112116483

(51) Int. Cl.

| | |
|---|---|
| ***F23D 14/38*** | (2006.01) |
| ***F23D 14/48*** | (2006.01) |
| ***F23Q 3/00*** | (2006.01) |
| *F23D 14/28* | (2006.01) |
| *F23D 14/46* | (2006.01) |

(Continued)

(52) U.S. Cl.

CPC ..... *F23D 14/38* (2013.01); *F23D 14/48* (2013.01); *F23Q 3/008* (2013.01); *F23D 14/28* (2013.01); *F23D 14/465* (2013.01); *F23D 14/52* (2013.01); *F23D 14/56* (2013.01); *F23D 14/58* (2013.01); *F23D 2201/10* (2013.01); *F23D 2207/00* (2013.01)

(58) Field of Classification Search

CPC ..... F23D 14/38; F23D 14/28; F23D 14/465; F23D 2207/00; F23D 2201/10; F23D 14/48; F23D 14/52; F23D 14/56; F23D 14/58; F23Q 3/008

USPC ..... 431/264

See application file for complete search history.

(56) References Cited

U.S. PATENT DOCUMENTS 4,391,582 A * 7/1983 Cowan ..... F23Q 3/008 431/266

5,921,768 A * 7/1999 Joncg ..... F23D 14/38 431/255

(Continued)

FOREIGN PATENT DOCUMENTS

CN 202048591 U 11/2011

CN 205402721 U 7/2016

(Continued)

*Primary Examiner* — Helena Kosanovic

*Assistant Examiner* — Benjamin W Johnson

(74) *Attorney, Agent, or Firm* — Muncy, Geissler, Olds & Lowe, P.C.

(57) ABSTRACT

A flame torch includes a body and a nozzle assembly. The body is provided with an igniter inside, and the igniter is connected to an electric arc wire. The nozzle assembly includes a barrel and a head seat. The barrel has a first end connected to the body, a second end opposite to the first end, and a gas conduit extending therethrough. The head seat is connected to the second end and has a spray hole and a side hole. The spray hole communicates with the gas conduit, allowing gas to pass through the gas conduit and spray through the spray hole. The side hole extends radially along the spray hole and communicates with the spray hole. One end of the electric arc wire is connected to the igniter, and the other end of the electric arc wire passes through the head seat and is inserted into the side hole.

10 Claims, 7 Drawing Sheets

(51) Int. Cl.

| | |
|---|---|
| *F23D 14/52* | (2006.01) |
| *F23D 14/56* | (2006.01) |
| *F23D 14/58* | (2006.01) |

(56) References Cited

U.S. PATENT DOCUMENTS

| | | | | |
|---|---|---|---|---|
| 2011/0053103 | A1* | 3/2011 | Burdsall | F23Q 3/002 431/353 |
| 2015/0354813 | A1* | 12/2015 | Yang | F23D 14/28 431/364 |
| 2017/0074510 | A1* | 3/2017 | Yang | F23D 14/28 |
| 2022/0235932 | A1 | 7/2022 | Wu et al. | |

FOREIGN PATENT DOCUMENTS

| | | | |
|---|---|---|---|
| CN | 217004455 | U | 7/2022 |
| CN | 217004456 | U | 7/2022 |
| TW | 117438 | U | 8/1989 |
| TW | 202227756 | A | 7/2022 |

* cited by examiner

FLAME TORCH

BACKGROUND OF THE INVENTION

The present invention relates to a flame torch and, more particularly, to a flame torch that can be ignited easily.

U.S. Publication No. US 2022/0235932 A1 discloses a tool includes a barrel, a guiding wire, and an electrically conductive member. The barrel is made of electrically conductive material. The guiding wire is disposed in the barrel. The barrel and the guiding wire are directly or indirectly connected to two opposite electrodes of a power source. The electrically conductive member is connected to an outer periphery of the guiding wire and is electrically connected to the guiding wire. The electrically conductive member is disposed between the barrel and the guiding wire and is spaced from the barrel. When the power source is activated, an electric arc is generated between the electrically conductive member and the barrel.

However, the tool uses the barrel as the conduit for gas injection. The direction and angle of gas injection are limited by the shape of the inner periphery of the barrel, resulting in a small range of flame provision. Additionally, an electric arc is generated between the conductive element and the barrel, which occurs at the location of extremely fast gas flow in the barrel. Consequently, even though the electric arc is easily generated, it is difficult to actually ignite the gas.

Thus, a need exists for a flame torch to mitigate and/or obviate the above disadvantages.

SUMMARY OF THE INVENTION

An objective of the present invention is to provide a flame torch that includes a body and a nozzle assembly. The body is provided with an igniter inside, and the igniter is connected to an electric arc wire. The nozzle assembly includes a barrel and a head seat. The barrel has a first end connected to the body, a second end opposite to the first end, and a gas conduit extending therethrough. The head seat is connected to the second end and has a spray hole and a side hole. The spray hole communicates with the gas conduit, allowing gas to pass through the gas conduit and spray through the spray hole. The side hole extends radially along the spray hole and communicates with the spray hole. One end of the electric arc wire is connected to the igniter, and the other end of the electric arc wire passes through the head seat and is inserted into the side hole. Thus, the gas is easily ignited by the electric arc.

In an embodiment, the nozzle assembly further includes a flow a rectifier arranged in the spray hole that is formed as a plate structure extending radially along the spray hole. The side hole communicates with two opposite spaces separated by the flow rectifier inside the spray hole.

In an embodiment, the flow rectifier is a circular plate having a first rectification aperture and four second rectification apertures penetrating the flow rectifier along a direction parallel to an axial direction of the spray hole. The first rectification aperture is disposed at a center of the flow rectifier and has a diameter smaller than a diameter of the second rectification aperture. The four second rectification apertures are symmetrically placed at two opposite sides of the first rectification aperture.

In another embodiment, the flow rectifier is a circular plate having a guiding flange adjacent to the second end of the barrel. The guiding flange is disposed at a center of the flow rectifier and is formed as a cone structure having an apex pointing towards the barrel.

In an embodiment, a side of the flow rectifier opposite to the second end of the barrel is provided with a recess disposed at the center of the flow rectifier and that aligns with the guiding flange. The recess is formed by extrusion as the flow rectifier is deformed by an external force.

In an embodiment, an inner periphery of the spray hole is provided with a straight section and a conical section. The straight section is disposed between the gas conduit and the conical section. The conical section has a distal end distal to the straight section and a proximal end adjacent to the straight section. An internal diameter of the distal end of the conical section is greater than an internal diameter of the proximal end of the conical section.

In an embodiment, an inner periphery of the conical section extends towards the straight section to form a reference intersection point. A distance from the intersection point to the distal end of the conical section forms a height. A ratio of the internal diameter to the height is greater than 1 and less than 2.

In an embodiment, the ratio of the internal diameter to the height is greater than 1.3 and less than 1.5.

In an embodiment, the nozzle assembly further includes an insulation tube sleeved around the electric arc wire. The insulation tube is arranged along a direction parallel to an axial direction of the spray hole. An end of the insulation tube is inserted into the side hole and the other end of the insulation tube protrudes outside the head seat. The head seat is made of metal. The electric arc wire is not in contact with the head seat.

In an embodiment, a portion of the electric arc wire inserted into the side hole forms an insertion length greater than a half of a diameter of the side hole.

In an embodiment, the nozzle assembly further includes an outer sleeve having a end connected to the body. The outer sleeve is sleeved around the barrel and the head seat.

The present invention will become clearer in light of the following detailed description of illustrative embodiments of this invention described in connection with the drawings.

DETAILED DESCRIPTION OF THE INVENTION

Figure 1:
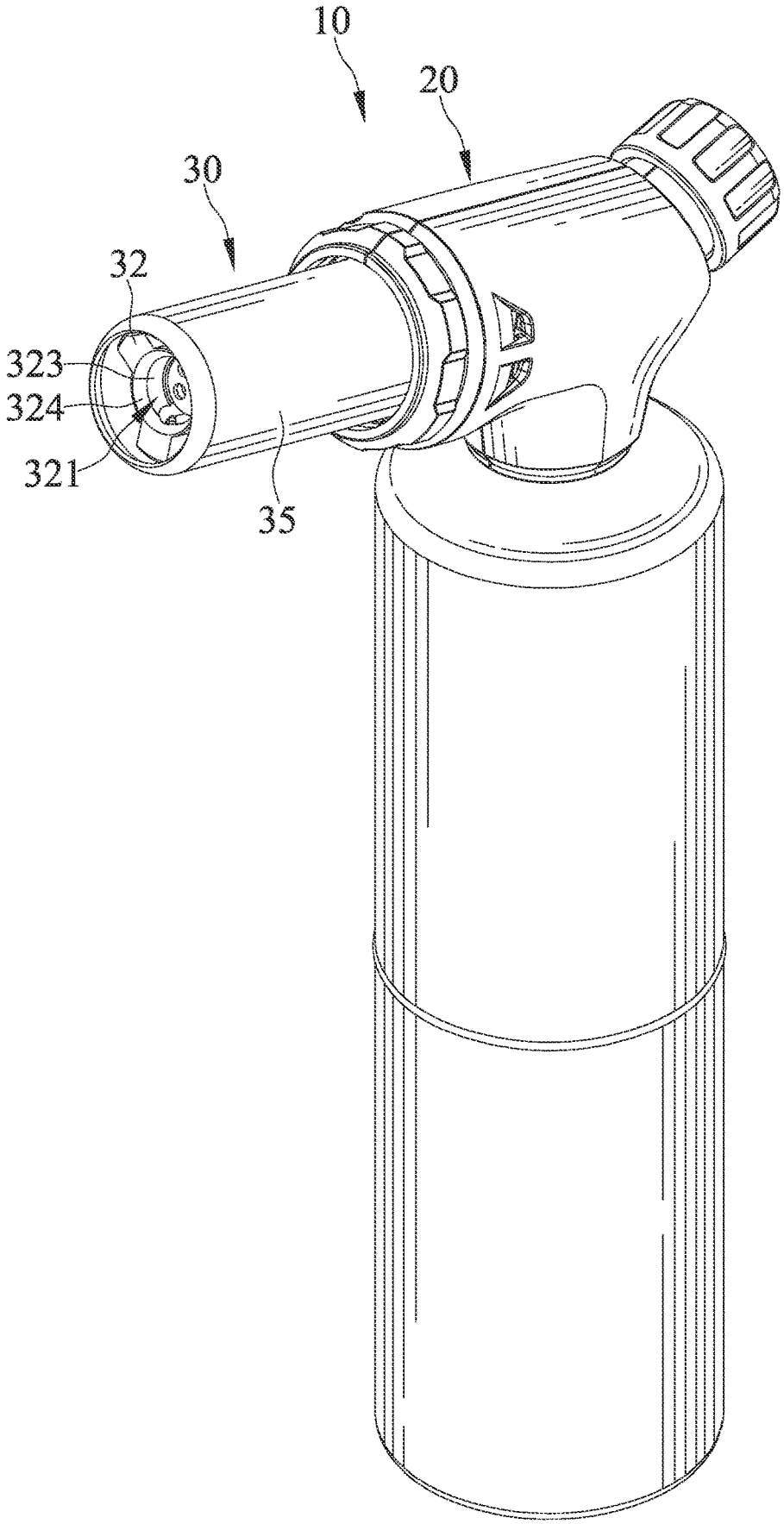
FIG. 1 is a perspective view of a flame torch of a first embodiment according to the present invention.
Figure 2:
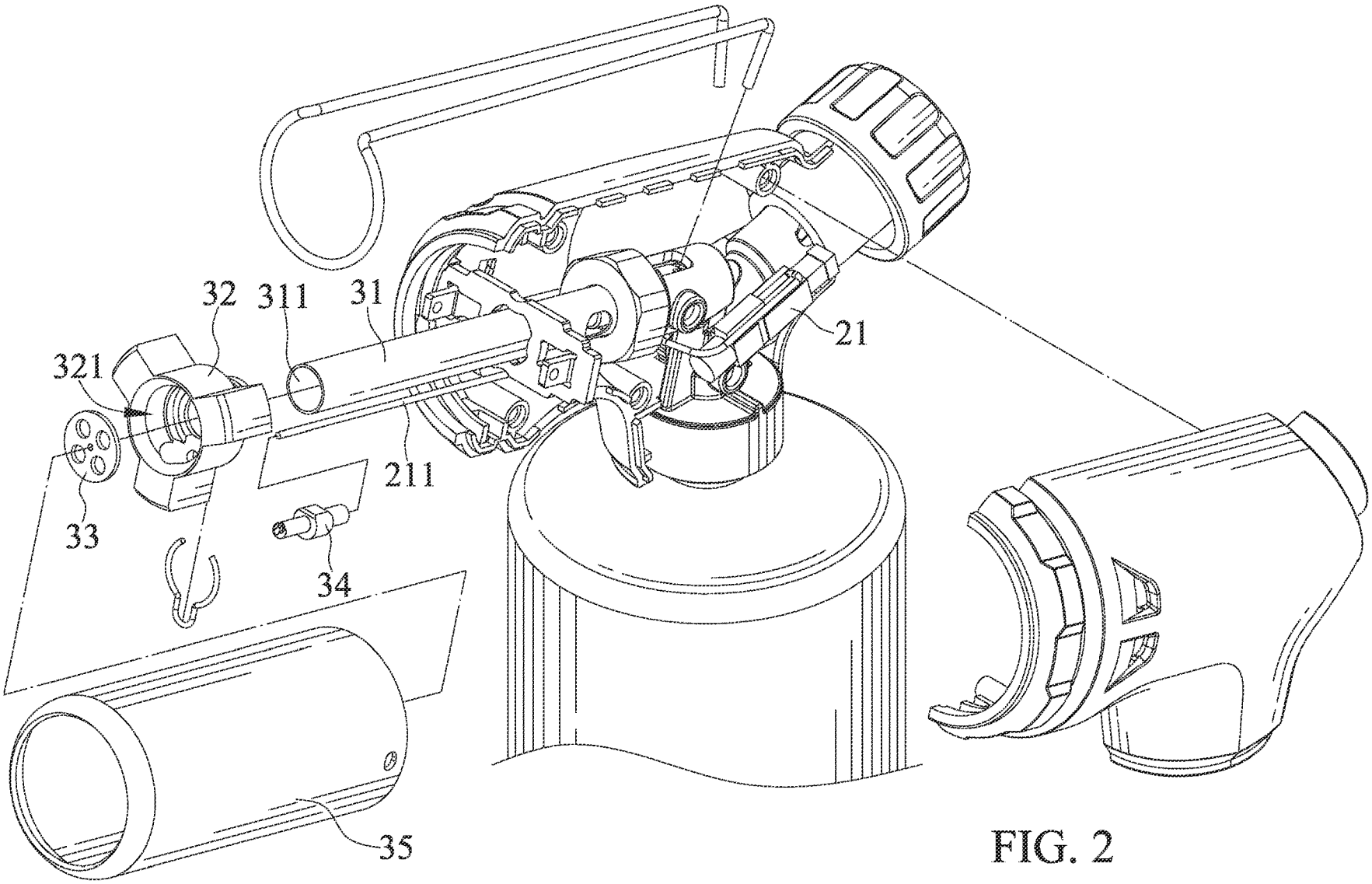
FIG. 2 is an exploded perspective view of the flame torch of FIG. 1.
Figure 3:
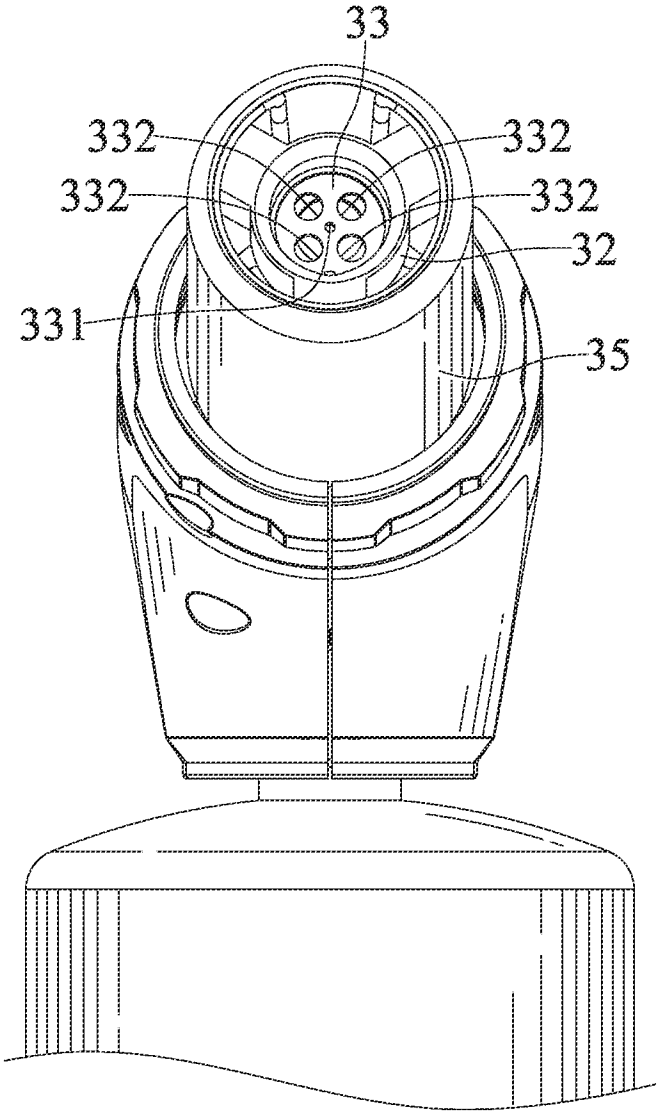
FIG. 3 is a side view of the flame torch of FIG. 1.
Figure 4:
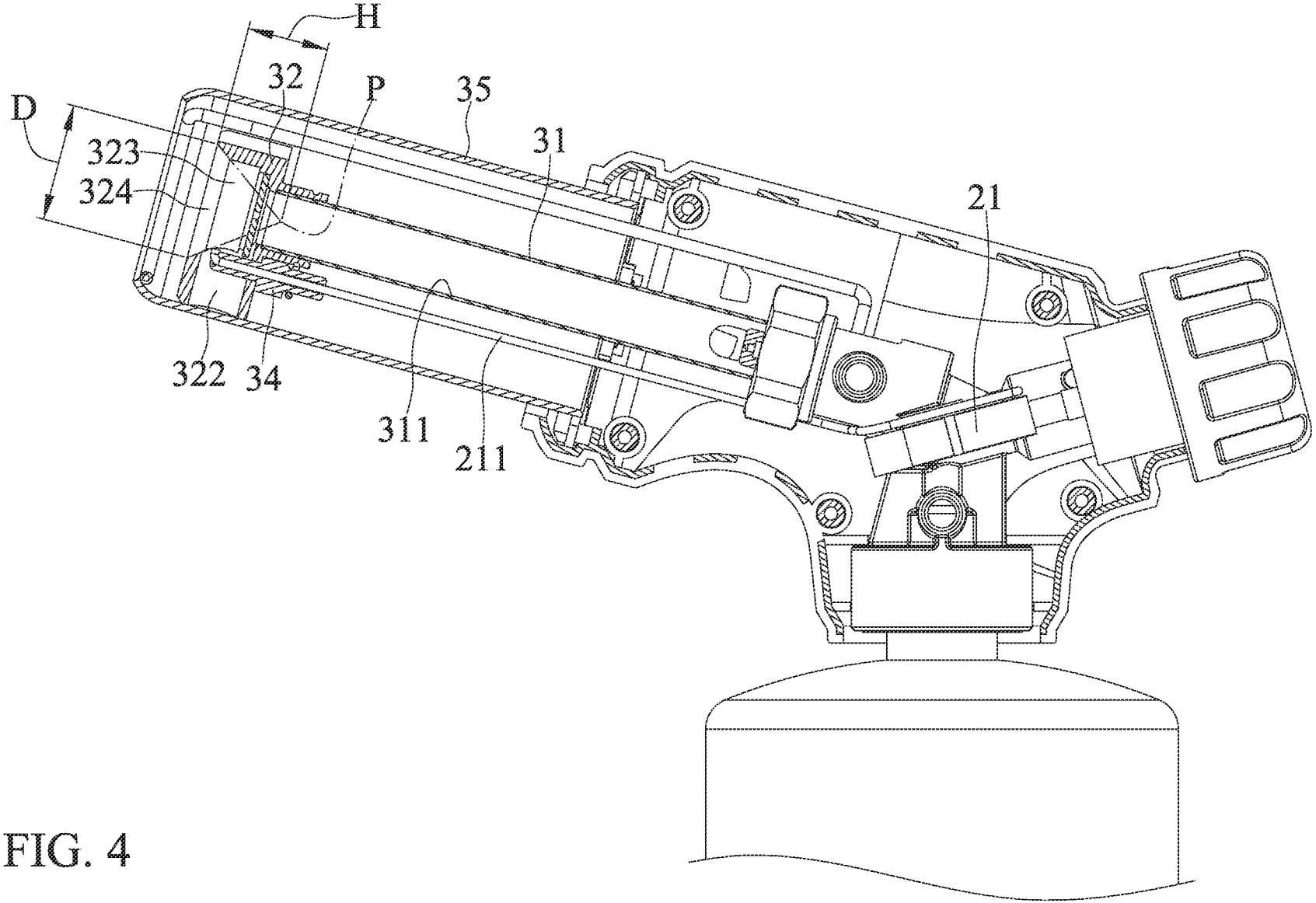
FIG. 4 is a cross sectional view of the flame torch of FIG. 1.
Figure 5:
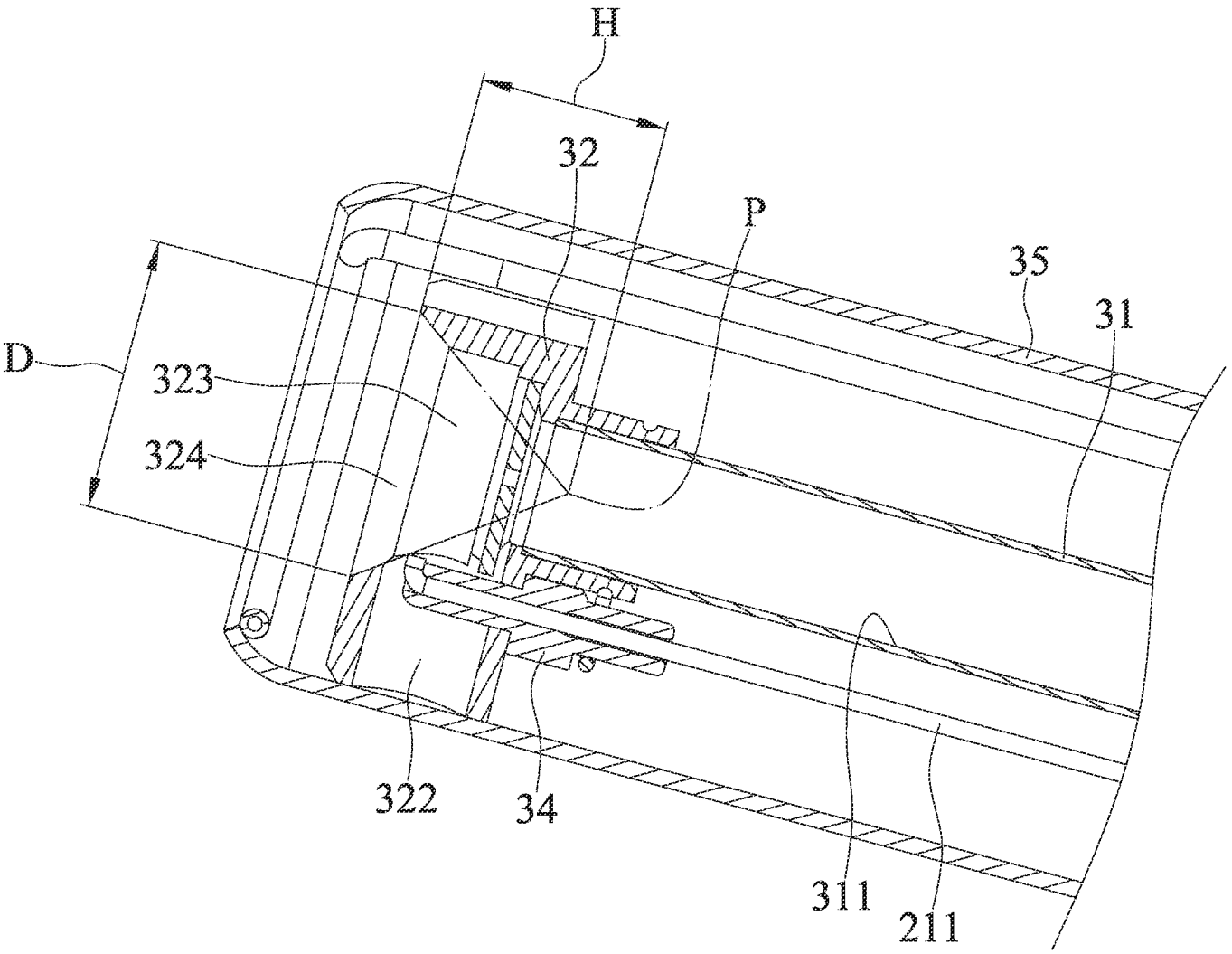
FIG. 5 is a partial enlarged cross sectional view of a head seat of the flame torch of FIG. 1.
Figure 6:
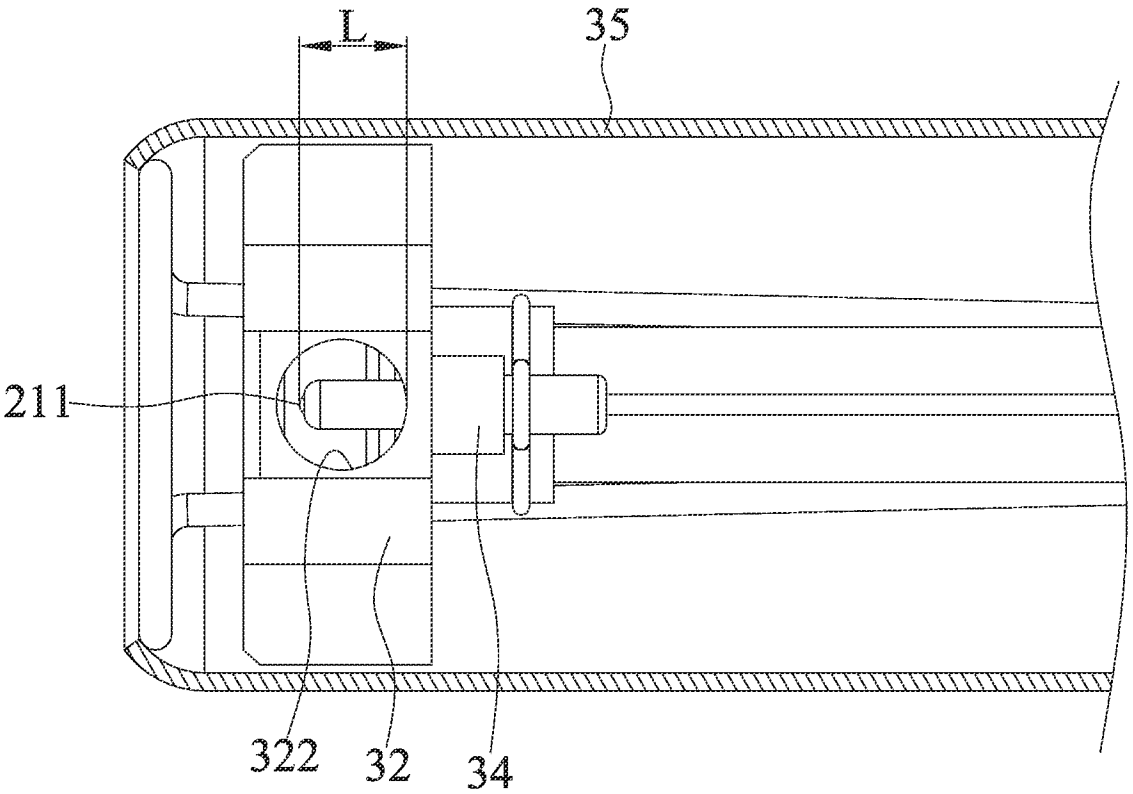
FIG. 6 is another partial enlarged cross sectional view of the head seat of the flame torch of FIG. 1.

FIGS. 1-6 show a flame torch of a first embodiment according to the present invention. The flame torch 10 includes a body 20 and a nozzle assembly 30.

The body 20 is provided with an igniter 21 inside, and the igniter 21 is connected to an electric arc wire 211.

The nozzle assembly 30 includes a barrel 31 and a head seat 32. The barrel 31 has a first end connected to the body 20, a second end opposite to the first end, and a gas conduit 311 extending therethrough. The head seat 32 is connected to the second end and has a spray hole 321 and a side hole 322. The spray hole 321 communicates with the gas conduit 311, allowing gas to pass through the gas conduit 311 and spray through the spray hole 321. The side hole 322 extends radially along the spray hole 321 and communicates with the spray hole 321. One end of the electric arc wire 211 is connected to the igniter 21, and the other end of the electric arc wire 211 passes through the head seat 32 and is inserted into the side hole 322.

The nozzle assembly 30 further includes a flow rectifier 33 arranged that a in the spray hole 321 that is formed as a plate structure extending radially along the spray hole 321. The side hole 322 communicates with two opposite spaces separated by the flow rectifier 33 inside the spray hole 321.

Further, the flow rectifier 33 is a circular plate having a first rectification aperture 331 and four second rectification apertures 332 penetrating the flow rectifier 33 along a direction parallel to an axial direction of the spray hole 321. The first rectification aperture 331 is disposed at a center of the flow rectifier 33 and has a diameter smaller than a diameter of the second rectification aperture 332. The four second rectification apertures 332 are symmetrically placed at two opposite sides of the first rectification aperture 331.

An inner periphery of the spray hole 321 is provided with a straight section 323 and a conical section 324. The straight section 323 is disposed between the gas conduit 311 and the conical section 324. The conical section 324 has a distal end distal to the straight section 323 and a proximal end adjacent to the straight section 323. An internal diameter D of the distal end of the conical section 324 is greater than an internal diameter of the proximal end of the conical section 324.

Further, an inner periphery of the conical section 324 extends towards the straight section 323 to form a reference intersection point P. A distance from the intersection point P to the distal end of the conical section 324 forms a height H. A ratio of the internal diameter D to the height H is greater than 1 and less than 2. In the embodiment, the ratio of the internal diameter D to the height H is greater than 1.3 and less than 1.5.

The nozzle assembly 30 further includes an insulation tube 34 sleeved around the electric arc wire 211. The insulation tube 34 is arranged along a direction parallel to an axial direction of the spray hole 321. An end of the insulation tube 34 is inserted into the side hole 322 and the other end of the insulation tube 34 protrudes outside the head seat 32. The head seat 32 is made of metal. The electric arc wire 211 is not in contact with the head seat 32.

A portion of the electric arc wire 211 inserted into the side hole 322 forms an insertion length L greater than a half of a diameter of the side hole 322.

The nozzle assembly 30 further includes an outer sleeve 35 having a end connected to the body 20. The outer sleeve 35 is sleeved around the barrel 31 and the head seat 32.

Therefore, the flame torch 10 is able to easily ignite the gas by the electric arc. When the gas provided from the body 20 reaches the conical section 324 through the straight section 323, the gas can diffuse and spray along the inner periphery of the conical section 324. Since the electric arc wire 211 of the igniter 21 does not contact the head seat 32, the electrical power provided by the igniter 21 can generate an arc and ignite the gas inside the spray hole 321 through the electric arc wire 211 within the side hole 322. Due to the low gas flow velocity inside the side hole 322, the gas is easily ignited by the electric arc. Furthermore, the gas that diffuses and sprays through the conical section 324 can generate a large area of flame after ignition.

Figure 7:
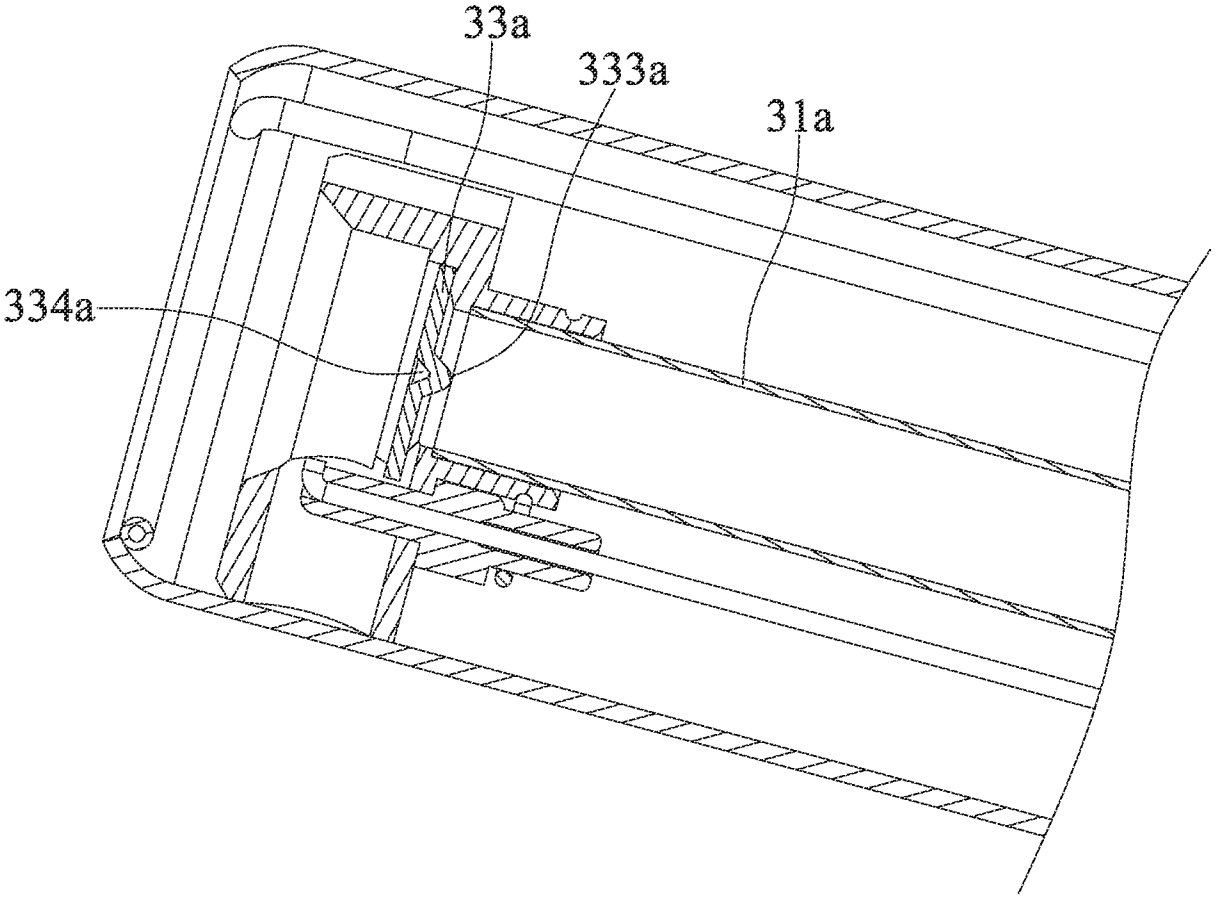
FIG. 7 is a partial enlarged cross sectional view of a head seat of a flame torch of a second embodiment according to the present invention.

FIG. 7 shows a flame torch of a second embodiment according to the present invention. The structure of the flame torch of this embodiment is substantially the same as that of the first embodiment except the following differences. Specifically, the flow rectifier 33*a* is a circular plate having a guiding flange 333*a* adjacent to the second end of the barrel 31*a*. The guiding flange 333*a* is disposed at a center of the flow rectifier 33*a*. The guiding flange 333*a* is formed as a cone structure having an apex pointing towards the barrel 31*a*.

Further, a side of the flow rectifier 33*a* opposite to the second end of the barrel 31*a* is provided with a recess 334*a* disposed at the center of the flow rectifier 33*a* and that aligns with the guiding flange 333*a*. The recess 334*a* is formed by extrusion as the flow rectifier 33*a* is deformed by an external force.

Although specific embodiments have been illustrated and described, numerous modifications and variations are still possible without departing from the scope of the invention. The scope of the invention is limited by the accompanying claims.

The invention claimed is:

1. A flame torch comprising:

a body provided with an igniter inside, wherein the igniter is connected to an electric arc wire; and a nozzle assembly including a barrel and a head seat, wherein the barrel has a first end connected to the body, a second end opposite to the first end, and a gas conduit extending therethrough, wherein the head seat is connected to the second end and has a spray hole and a side hole, wherein the spray hole communicates with the gas conduit, allowing gas to pass through the gas conduit and spray through the spray hole, wherein the side hole extends radially along the spray hole and communicates with the spray hole, and wherein one end of the electric arc wire is connected to the igniter, and the other end of the electric arc wire passes through the head seat and is inserted into the side hole, wherein the nozzle assembly further includes a flow rectifier arranged in the spray hole, wherein an inner periphery of the spray hole is provided with a straight section and a conical section, wherein the straight section is disposed between the gas conduit and the conical section, wherein the flow rectifier is positioned between the gas conduit and the conical section, wherein the conical section has a distal end distal to the straight section and a proximal end adjacent to the straight section, wherein the distal end of the conical section is formed on a terminal end of the head seat, and wherein an internal diameter of the distal end of the conical section is greater than an internal diameter of the proximal end of the conical section.

2. The flame torch as claimed in claim 1, wherein the flow rectifier is formed as a plate structure extending radially along the spray hole, and wherein the side hole communicates with two opposite spaces separated by the flow rectifier inside the spray hole.

3. The flame torch as claimed in claim 2, wherein the flow rectifier is a circular plate having a first rectification aperture and four second rectification apertures penetrating the flow rectifier along a direction parallel to an axial direction of the spray hole, wherein the first rectification aperture is disposed at a center of the flow rectifier and has a diameter a smaller than a diameter of the second rectification apertures, and wherein the four second rectification apertures are symmetrically placed at two opposite sides of the first rectification aperture.

4. The flame torch as claimed in claim 2, wherein the flow rectifier is a circular plate having a guiding flange adjacent to the second end of the barrel, wherein the guiding flange is disposed at a center of the flow rectifier, and wherein the guiding flange is formed as a cone structure having an apex pointing towards the barrel.

5. The flame torch as claimed in claim 4, wherein a side of the flow a rectifier opposite to the second end of the barrel is provided with a recess disposed at a center of the flow rectifier that aligns with the guiding flange, and wherein the recess is formed by extrusion as the flow rectifier is deformed by an external force.

6. The flame torch as claimed in claim 1, wherein an inner periphery of the conical section extends towards the straight section to form a reference intersection point, wherein a distance from the intersection point to the distal end of the conical section forms a height, and wherein a ratio of the internal diameter to the height is greater than 1 and less than 2.

7. The flame torch as claimed in claim 6, wherein the ratio of the internal diameter to the height is greater than 1.3 and less than 1.5.

8. The flame torch as claimed in claim 1, wherein the nozzle assembly further includes an insulation tube sleeved around the electric arc wire, wherein the insulation tube is arranged along a direction parallel to an axial direction of the spray hole, wherein an end of the insulation tube is inserted into the side hole and the other end of the insulation tube protrudes outside the head seat, wherein the head seat is made of metal, and wherein the electric arc wire is not in contact with the head seat.

9. The flame torch as claimed in claim 8, wherein a portion of the electric arc wire inserted into the side hole forms an insertion length greater than a half of a diameter of the side hole.

10. The flame torch as claimed in claim 9, wherein the nozzle assembly further a includes an outer sleeve having an end connected to the body, and wherein the outer sleeve is sleeved around the barrel and the head seat.

* * * * *